US005808553A

United States Patent [19]

Cunningham

[11] Patent Number: 5,808,553

[45] Date of Patent: Sep. 15, 1998

[54] APPARATUS FOR ENFORCING HYGIENE

[76] Inventor: William B. Cunningham, P.O. Box 25463, Oklahoma City, Okla. 73125

[21] Appl. No.: 958,791

[22] Filed: Oct. 29, 1997

[51] Int. Cl.[6] ..... G08B 23/00

[52] U.S. Cl. ..... 340/573; 340/686; 340/545; 340/528

[58] Field of Search ..... 340/573, 686, 340/691, 545, 528; 70/144

[56] References Cited

U.S. PATENT DOCUMENTS 3,967,478 7/1976 Guinn ..... 70/144
4,896,144 1/1990 Bogstad ..... 340/691
5,202,666 4/1993 Knippscheer ..... 340/573
5,610,589 3/1997 Evans et al. ..... 340/573

*Primary Examiner*—Jeffery A. Hofsass
*Assistant Examiner*—Benjamin C. Lee
*Attorney, Agent, or Firm*—Robert K. Rhea

[57] ABSTRACT

An apparatus for unlocking the door to a hygienic area is formed by a circuit having a pair of series connected, normally open push button switches disposed in spaced apart relation at lateral limits of a lavatory. When the switch buttons are simultaneously depressed for a predetermined time, as by the little finger of each hand of a worker, soap sprays from overhead spray heads on the worker's hands, and after the predetermined time delay, unlocks the door.

2 Claims, 2 Drawing Sheets

APPARATUS FOR ENFORCING HYGIENE

CROSS REFERENCE TO RELATED APPLICATIONS

Not applicable

STATEMENT REGARDING FEDERALLY SPONSORED RESEARCH OR DEVELOPMENT

Not applicable

BACKGROUND OF THE INVENTION

This invention relates to improvements in methods and apparatus for enforcing hygiene particularly in restaurants and health care facilities.

1. Field of the Invention

It is well known that bacteria and other micro-organisms are the cause of many contagious diseases and are easily transmitted from infected individuals to other persons if sanitary conditions are not maintained where such micro-organisms thrive. Customers or patients are susceptible to receiving into their bodies bacteria and other organisms and diseases such as hepatitis, which is easily transmitted from an infected person to other people by service personnel failing to wash their hands with soap and water after using a rest room. Presently the requirement for employees or service personnel to wash their hands is attempted by the posting of signs or intermittent checks by supervisory personnel.

2. Description of the Prior Art

U.S. Pat. No. 5,202,666 issued Apr. 13, 1993 to Knippscheer for Method and Apparatus for Enhancing Hygiene discloses a system in which a monitoring device is automatically actuated when an individual enters a washroom, and determines whether or not he has washed his hands before leaving the room. A first signal is generated upon entry to the room, and a second signal is generated upon sensing the individual has exited the washroom. A third signal is generated indicating the individual has washed his hands. An alert signal is generated by the first and second signal received in the absence of the third hand washing signal. This alert signal energizes a signal cognisable by a human being that the individual has not washed his hands before exiting the sanitation area.

U.S. Pat. No. 3,967,478 issued Jul. 6, 1976 to Guinn for Door Latching Apparatus Actuated by Cleansing Agent Sensor, and U.S. Pat. No. 4,896,144 issued Jan. 23, 1990 to Bogstad for Hand Washing Alert are believed good examples of the further state-of-the-art.

The Guinn patent discloses a sanitation area in which an employee entering the area must wash his hands with an electrolytic soap or cleansing agent in which a small amount of the electrolytic agent remains on the hands or forearms to such an extent that one arm can be placed across the position of pair of spaced contacts, closing a circuit to open the door and exit the area. Without the soap on hands or arms, the door cannot be opened.

The Bogstad patent discloses an audible warning system to announce to the employee that he has not washed his hands if he attempts to leave the area at the moment he opens the exit door.

It is believed each of the above described patented devices may be circumvented by an employee activating the several components without actually using them, such as by tripping a soap dispenser without receiving soap on his hands, opening a faucet, triggering the operation of a dryer or bridging electrical terminals generating signals necessary for the opening of the exit door.

This invention is believed distinctive over these and similar patents by providing a lavatory or the like with laterally spaced normally open switch buttons which must be simultaneously closed a predetermined time span by the little finger of each hand of an individual, dispensing a disinfectant soap on his hands which also generates a completion signal and unlocks the exit door.

BRIEF SUMMARY OF THE INVENTION

This invention provides a system and method for requiring workers in a hygienically controlled area to wash their hands with soap and water before exiting the sanitation area. The sanitation area contains the usual bathroom facilities, and is preferably a small electric circuit control door closed area accommodating one worker at a time. The door is entered by entering a code in a door control unit adjacent the door, which also turns on the lights. Upon the entry, the door automatically locks behind the worker and will not open until a certain sequence of steps are performed by the worker using the facilities. The worker, using both little fingers of his hands, pushes dual buttons on opposite sides of a lavatory simultaneously which sprays a quantity of disinfectant soap on his hands and closes a circuit and unlocking the door. The worker must wash his hands to rid them of the disinfecting soap before exiting the sanitation area. Opening the door and leaving locks the door and turns off the lights.

The principal object of this invention is to insure that food service or health care service employees wash their hands each and every time they use rest room facilities.

DESCRIPTION OF THE PREFERRED EMBODIMENTS

Figure 1:
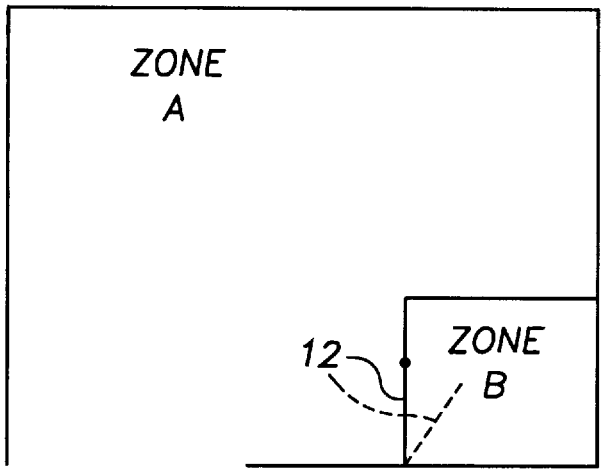
FIG. 1 is a layout of a work area and rest room.
Figure 2:
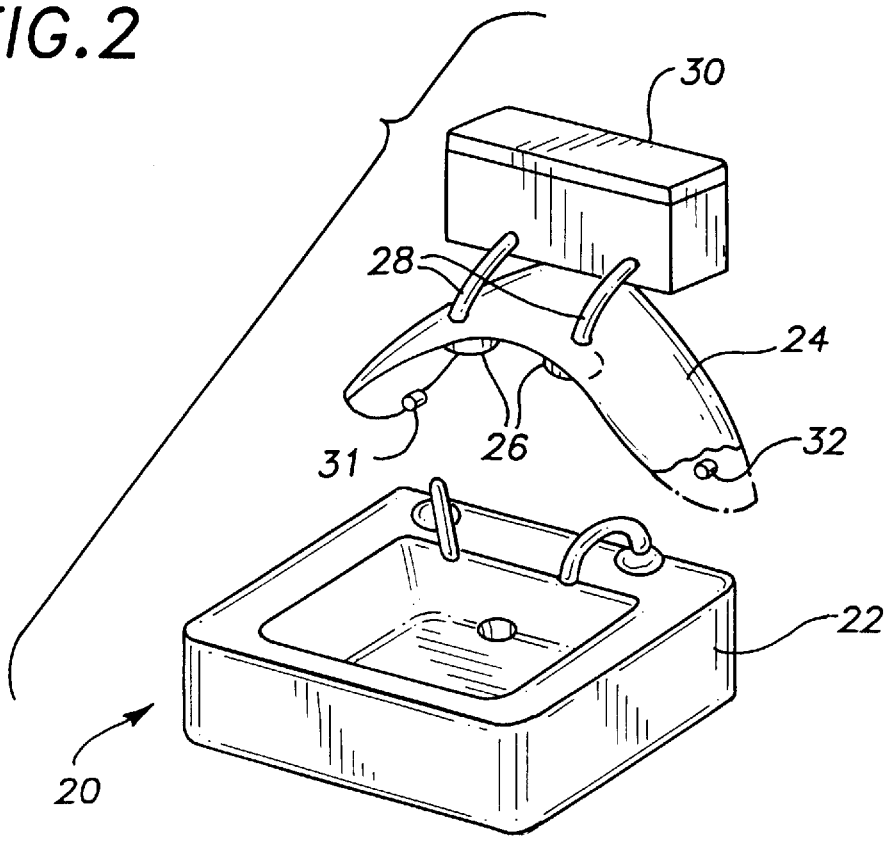
FIG. 2 is a perspective illustrating a washing station in the rest room.
Figure 3:
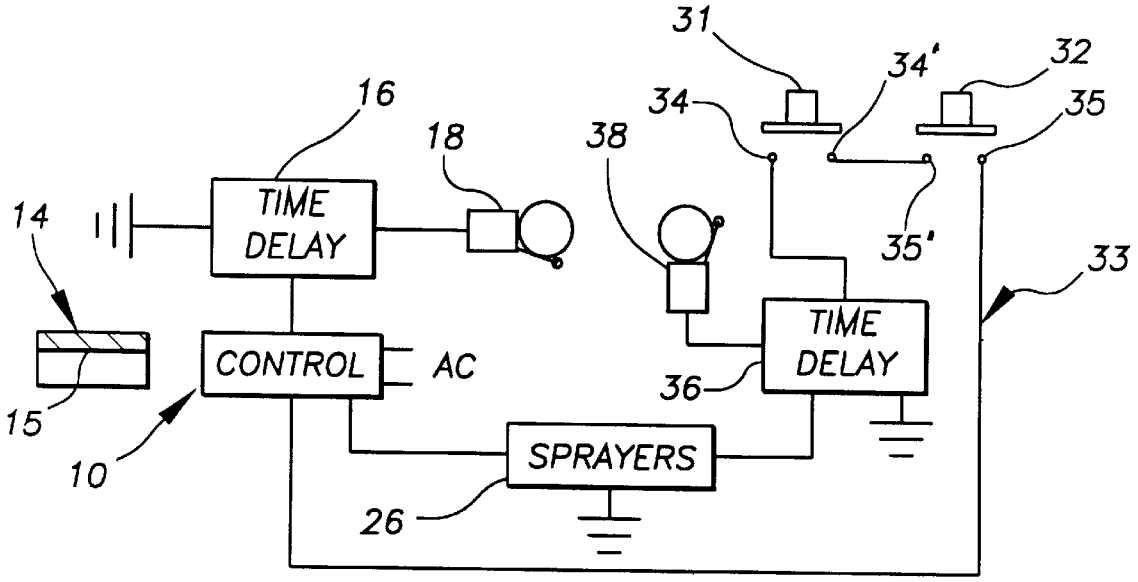
FIG. 3 is a wiring diagram.
Figure 4:
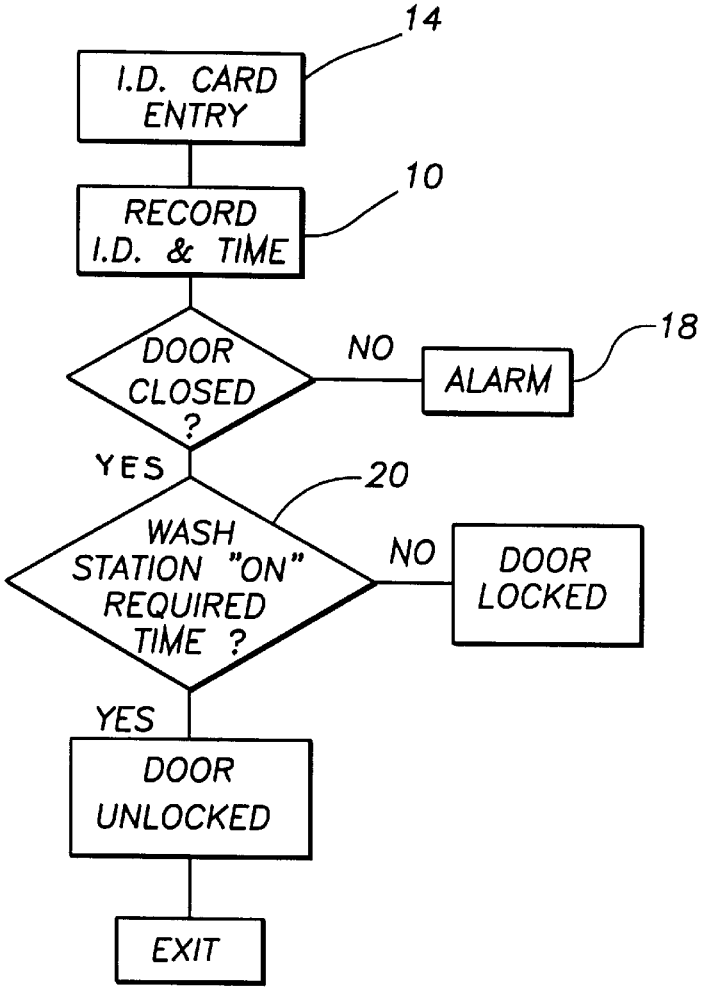
FIG. 4 is a flow diagram.

Like characters of reference designate like parts in those figures of the drawings in which they occur.

In the drawings:

The system comprises of three specific components:

1. An electronic door controller normally maintaining the zone B door closed;

2. a name tag enabling a worker to open the zone B door; and, 3. a hand washing and sanitizing station.

The reference numeral 10 indicates an electronic door control means which is preferably mounted on or adjacent the zone B door 12 and is connected with a source of electrical energy AC, and normally maintains the door 12 in a locked condition and when the zone B is unoccupied displays a "vacant" sign.

The reference numeral 14 indicates an identification card having a magnetic code strip 15 identifying the owner and unlocking the door 12 when inserted into a slot, not shown, in the housing of the control unit 10 and recording the user's name and time of entering the zone B. Unlocking the door 12 by the ID card 14 starts a first time delay 16 connected with a visual and/or audible signal 18 which is energized in the event the worker has not entered the door 12 and closed it within a limited time, for example, ten seconds. Closing the door locks it and illuminates the zone B area.

After the worker uses the facilities of the sanitation zone B, he approaches the sanitation station 20. The station 20 comprises a conventional water faucet equipped lavatory 22 under a hood-like enclosure 24 supporting a pair of spray heads 26 which are connected as by tubing 28, with a reservoir 30 of soap containing a sanitizing agent. A pair of switch buttons 31 and 32 are mounted under the hood 24 above respective lateral limits of the lavatory 22. Both of these buttons 31 and 32 must be simultaneously depressed or pushed, as by the little finger of each hand of a worker, for a specified time limit, for example ten seconds.

The buttons 31 and 32 close a circuit 33 energizing the spray heads 26 to spray soap on a worker's hands. This energizes a second time delay means 36 connected with a second visual and/or audible signal 38 which is energized to indicate that the time has elapsed for releasing the buttons 31 and 32 from contact with electrical terminals 34-34' and 35-35'. Depressing the buttons 31 and 32 bridges the terminals 34-34' and 35-35' and after a specified time limit, for example, ten seconds, resets the control unit 10 and unlocks the door 12 for a worker to exit the facility after washing his hands to remove the soap.

Obviously the invention is susceptible to changes or alterations without defeating its practicability. Therefore, I do not wish to be confined to the preferred embodiment shown in the drawing and described herein.

I claim:

1. An apparatus for enhancing hygiene including a rest room having a water faucet equipped lavatory and having a normally locked ingress/egress door opened in response to the reception of a preselected code, the improvement comprising:

an electronic door control means connected with a source of electrical energy and having a housing mounted on or adjacent said door and adapted to recognize said code when entered for unlocking the door;

a first time delay circuit means energized by the opening of said door for energizing an alarm if said door is not closed before said first time delay times out;

electrically operated liquid soap spray heads disposed in predetermined spaced relation above the lavatory;

a reservoir of liquid soap connected with said spray heads;

an electric circuit connecting said spray heads with the source of electrical energy in series through a pair of normally open spaced-apart push button switches disposed at respective lateral limits of said lavatory; and, a second time delay circuit means interposed in the spray head circuit and energized with said spray heads by simultaneously closing said push button switches for energizing a completion signal and unlocking the door at the conclusion of a predetermined time delay.

2. The apparatus according to claim 1 and further including:

a worker identification card containing said code and adapted to be received by said door control means.

* * * * *